US006019038A

United States Patent [19]

Kusunoki et al.

[11] Patent Number: 6,019,038

[45] Date of Patent: Feb. 1, 2000

[54] APPARATUS FOR REPLACEMENT OF AN INKING ROLLER OR THE LIKE IN A ROTARY PRINTING PRESS OR THE LIKE

[75] Inventors: Kenji Kusunoki; Taiichi Ichisawa, both of Kanagawa, Japan

[73] Assignee: Kabushiki Kaisha Tokyo Kikai Seisakusho, Japan

[21] Appl. No.: 09/154,089

[22] Filed: Sep. 16, 1998

[30] Foreign Application Priority Data

Nov. 21, 1997 [JP] Japan ..... 9-320724

[51] Int. Cl.[7] ..... B41F 31/30

[52] U.S. Cl. ..... 101/216; 101/352.06

[58] Field of Search ..... 101/216, DIG. 38, 101/350.3, 352.06

[56] References Cited

U.S. PATENT DOCUMENTS

| | | | |
|---|---|---|---|
| 2,605,701 | 8/1952 | Huebner | 101/216 |
| 4,088,074 | 5/1978 | Dahlgren et al. | 101/DIG. 38 |
| 4,262,590 | 4/1981 | Bruckner | 101/216 |

FOREIGN PATENT DOCUMENTS

P06-5891 2/1994 Japan .

*Primary Examiner*—Ren Yan
*Assistant Examiner*—Amanda B. Sandusky
*Attorney, Agent, or Firm*—Rader, Fishman & Grauer; Ronald P. Kananen

[57] ABSTRACT

An inking roller has a pair of journals coaxially coupled to its opposite ends, the journals being supported by frame means for both rotation and axial reciprocation with the roller. The journals are detachable from the roller by being moved axially away therefrom, as when the roller becomes worn or flawed and needs replacement. A pair of guide rails are removably mounted to the frame means so as to extend in parallel spaced relationship to each other. On being freed from the journals, the roller rests on the guide rails for rolling thereon between a mount/dismount position, where the roller is mounted to and dismounted from the frame means via the journals, and a load/unload position where the roller is loaded into and unloaded from the press. A drive lever coupled to one of the journals to impart linear reciprocation to the roller is deprived of its fulcrum to permit that journal to travel axially away from the roller for disconnection.

8 Claims, 4 Drawing Sheets

APPARATUS FOR REPLACEMENT OF AN INKING ROLLER OR THE LIKE IN A ROTARY PRINTING PRESS OR THE LIKE

BACKGROUND OF THE INVENTION

This invention relates generally to machines such as rotary printing presses having rollers, cylinders or the like that need replacement, and pertains more specifically to means for use in replacing such rollers or the like. Still more specifically, the invention deals with how to replace an inking roller of a rotary printing press when it is worn or impaired, that roller being not only rotated but axially reciprocated during printing operation.

Japanese Examined Utility Model Publication No. 6-5891 is hereby cited as teaching a typical conventional method of inking roller replacement. It suggests the use of an inking roller having a pair of bosses projecting coaxially from its opposite ends. These bosses are received in holes in the opposed, enlarged ends of a pair of journals which are coaxially supported by bearing portions on confronting frame means of the press for both rotation and axial reciprocation with the roller. In order to make the roller removable from the journals for replacement, the enlarged ends of the journals are bisected, and the holes are each defined by a fixed segment of semicylindrical shape that is integral with one journal, and a removable segment of like shape that is screwed to the fixed segment to engage one roller boss therebetween. The journals are detachable from the roller bosses by unscrewing the removable segment. Removably mounted under the inking roller are a pair of medially pivoted rails along which the roller, disconnected from the journals, is to roll to a position of withdrawal from the machine.

For uncoupling this prior art inking roller from the journals, the roller must first be rotated with the journals to such an angular position that the mating surfaces of the fixed and removable segments of the enlarged journal ends are at an angle of approximately 62 degrees to the perpendicular. The journals are locked in this angular position by a pair of positioning arms held against them.

Then the pair of guide rails are turned about their medial pivots by manipulation of turnbuckles until the rails become engaged, each at one end thereof, in annular grooves which are cut in the bosses on both ends of the inking roller. The rails are now held at such an angle that their ends engaged with the inking roller are lower than the other ends. A pair of roller retainers are then mounted one to each guide rail for retaining the roller thereon against accidental rolling.

Then comes the step of unscrewing the removable segments of the enlarged journal ends from the fixed segments and thereby freeing the terminal bosses of the inking roller, although the bosses are now still cased in the half-holes in the fixed segments because of the above specified angular position of the journals. Then the turnbuckles are again manipulated to make the guide rails horizontal, whereupon the roller bosses will come out of the half-holes in the fixed segments onto the guide rails. Then, with the roller retainers removed, the inking roller is rolled over the guide rails to a preassigned unloading position.

The above summarized method of inking roller replacement is objectionable in more reasons than one. The first objection concerns the bisecting of the enlarged ends of the journals in defining holes for receiving the inking roller bosses. Such journals are difficult to manufacture, and it is even more difficult to connect and disconnect the roller bosses to and from the journals. The journals must be held with the mating surfaces of the fixed and removable segments more or less exactly at the noted angle of 62 degrees to the perpendicular for engaging and disengaging the roller bosses. No smooth engagement and disengagement is possible when the journals are in other than the required angular position.

Another objection arises from the fact that the inking roller rotates and axially reciprocates at the same time. As an inevitable result of this dual motion of the roller, the annular grooves of the roller may not be aligned with the guide rails when the roller is rotated to the required angular position for connection to or disconnection from the journals. Should the roller be then further rotated, and so moved axially, to bring the grooves into alignment with the guide rails, the roller would turn away from the required angular position. This difficulty is averted according to the prior art by making the guide rails movable back and forth axially of the roller, at the cost of additional means and additional labor.

A further objection to the prior art is the multiplicity and complexity of the parts and components needed for roller replacement. They include, in addition to the indispensable guide rails, the pair of turnbuckles for pivotally moving the guide rails, the pair of roller retainers for preventing the undesired rolling of the roller on the guide rails, and the pair of positioning arms for angularly positioning the journals with respect to the roller. All these parts must be mounted to the frames of the printing press each time the inking roller is replaced, and dismounted upon completion of replacement, making the roller replacement very troublesome and time-consuming. Furthermore, the prior art replacement means were costly in construction and susceptible to malfunctioning.

SUMMARY OF THE INVENTION

The present invention thoroughly overcomes the noted drawbacks and weaknesses of the prior art as typified by the inking roller replacement means of a rotary printing press and makes roller replacement far easier and speedier, by use of means that are far fewer in component parts, simpler in construction, and more trouble-free in operation, than heretofore.

Stated in its perhaps broadest aspect, the invention provides, in a machine such as a rotary printing press, the combination comprising a roller such as an inking roller having a pair of wheel means formed coaxially on opposite ends thereof. A pair of journals are coaxially supported by frame means for both rotation and axial displacement relative to the frame means, the journals being coupled to the opposite ends of the roller in coaxial relationship thereto so as to be uncoupled therefrom by being moved axially away from the roller. Also included are a pair of guide rails mounted to the frame means and extending in parallel spaced relationship to each other in a direction at right angles with the axis of the roller. On being uncoupled from the journals, the roller is free to travel laterally on the guide rails, with the wheel means in rolling engagement therewith. The guide rails extend from a mount/dismount position, where the roller is mounted to and dismounted from the frame means via the journals, to a load/unload position where the roller is loaded into and unloaded from the machine.

Preferably, the roller has a pair of depressions formed coaxially in its opposite ends, and the pair of journals have collars formed thereon for mating engagement in the depressions in the roller. The collars are secured to the roller by fastener elements such as screws.

When the present invention is applied to the inking roller of a rotary printing press, as in the preferred embodiments to be presented subsequently, the roller is both rotated and axially reciprocated with the journals relative to the frame means during printing operation. The pair of guide rails are dismounted from the frame means during such operation. Only when the roller is to be replaced on being worn or damaged are the guide rails mounted to the frame means. The roller may then be moved axially into rolling engagement with the guide rails. Then the journals may be disengaged and moved axially away from the opposite ends of the roller, leaving the roller in the mount/dismount position on the guide rails, from which position the roller may be rolled over to the load/unload position along the rails.

It should be appreciated that the journals are disconnected from the roller simply by unscrewing fastener elements securing their collars and moving the journals axially away in opposite directions from the roller. Unlike the prior art, therefore, the journals are disconnectable from the roller regardless of the angular position of the roller in which it has made rolling engagement with the guide rails. No means are needed for laterally readjusting the guide rails into rolling engagement with the roller. The guide rails need not be pivoted, either, so that turnbuckles or the like which have been conventionally used to swing the rails are also unnecessary.

There are additional advantages arising from the above described method of coupling the journals to the roller. The roller with the concentric depressions in its opposite ends, and the journals with the concentric collars on their opposed ends, are both easy to fabricate to the most stringent dimensional and positional specifications. So fabricated, the roller and the journals are connectable to each other with a high degree of axial alignment and disconnectable without a hitch.

The invention also features means coupled to one of the journals for axially reciprocating the roller relative to the frame means, the reciprocating means being adapted to permit said one journal to travel axially away from the roller, on being uncoupled therefrom, a sufficient distance to permit the roller to travel laterally along the pair of guide rails.

Typically, the reciprocating means include a lever medially pivoted on fulcrum means such as a bracket on the frame means. The lever has one end operatively coupled to linearly reciprocating drive means, and another end operatively coupled to one of the journals. During printing operation the inking roller is axially reciprocated as the lever is bidirectionally swung about its median pivot by the drive means. The bracket on which the lever is fulcrumed includes a segment that can be unfastened from the rest of the bracket to free the pivot pin of the lever. One of the journals is then free, on being uncoupled from the roller, to travel axially away therefrom the required distance.

Thus, all that is employed to make possible the axial displacement of one journal is the bracket segment which is readily separable as by loosening the screws. The reciprocating means is therefore not substantially made complex, bulky or expensive in order to permit axial displacement of the journal away from the roller.

The above and other features and advantages of this invention and the manner of realizing them will become more apparent, and the invention itself will best be understood, from a study of the following description and appended claims, with reference had to the attached drawings showing the preferred embodiments of the invention.

DESCRIPTION OF THE PREFERRED EMBODIMENTS

General

Figure 1:
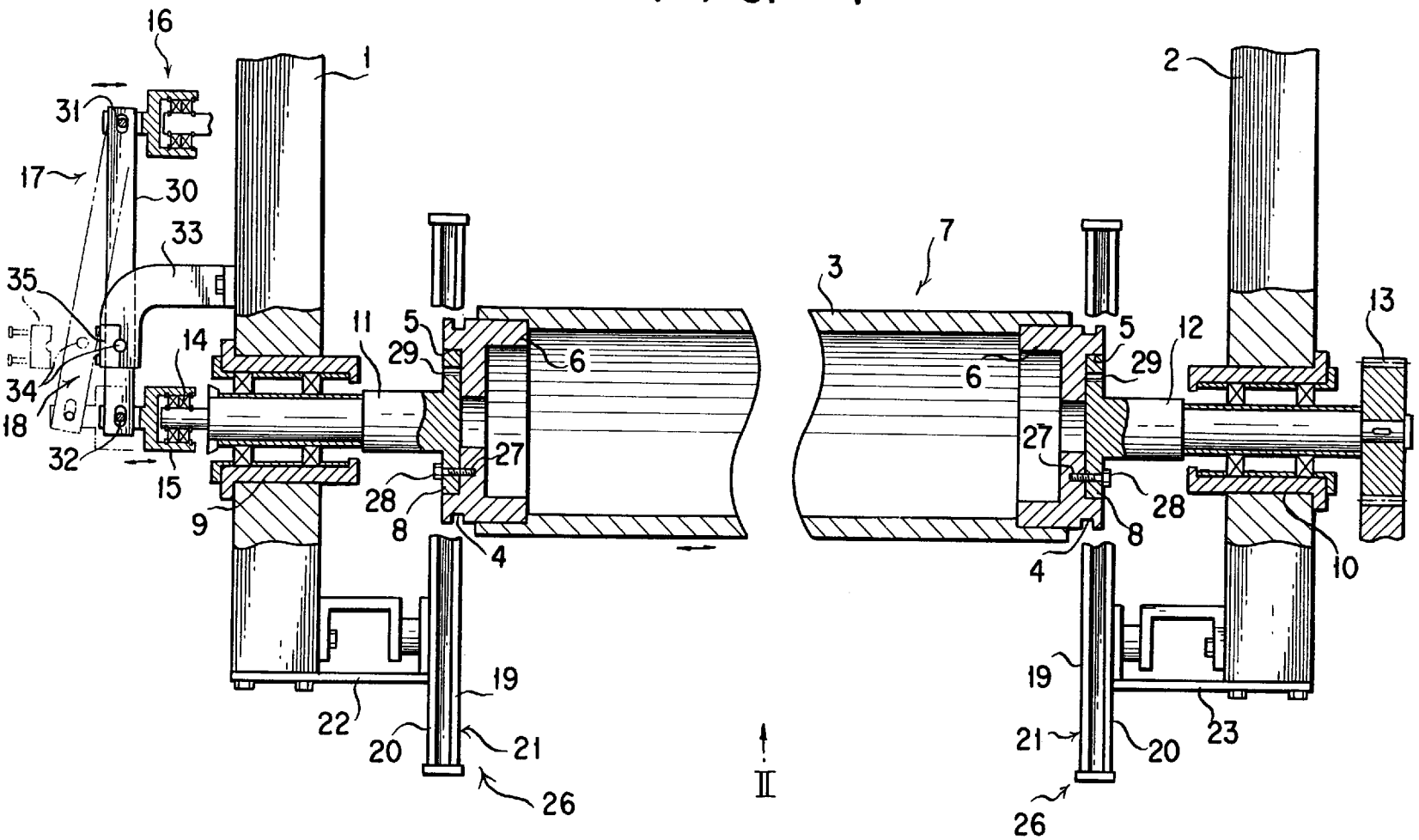
FIG. 1 is a top plan, with parts shown in axial section and parts shown broken away for illustrative convenience, of the inking roller, together with roller replacement means shown mounted in position, of a rotary printing press embodying the principles of this invention.
Figure 2:
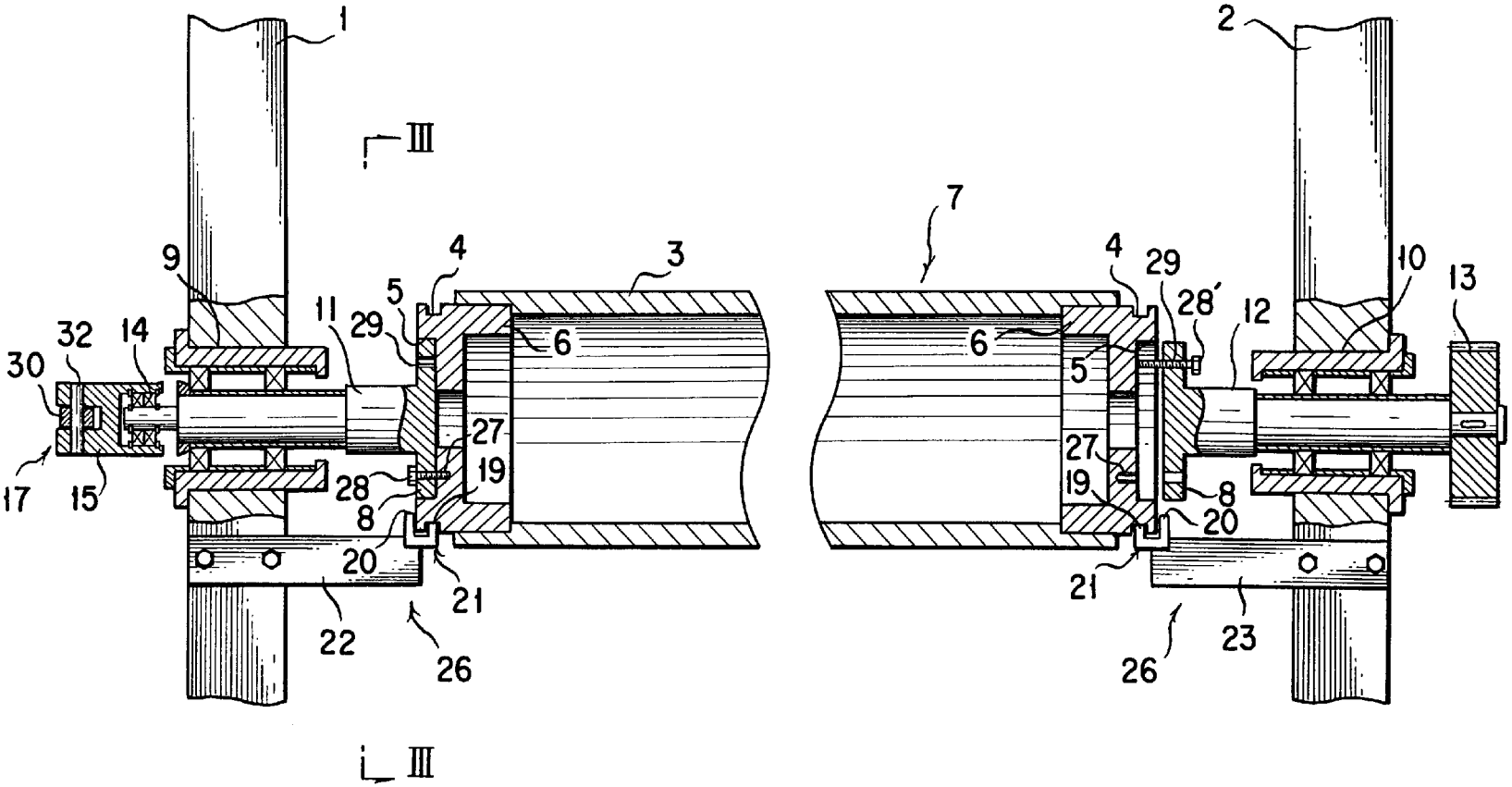
FIG. 2 is a front elevation, with parts shown in axial section and parts shown broken away for illustrative convenience, of showing the FIG. 1, seen in the direction of the Arrow E in FIG. 1, FIG. 2 differing from FIG. 1 in that the right hand one, as seen in this figure, of the pair of journals is shown disconnected from the inking roller.

The present invention will now be set forth in more specific aspects thereof and as applied to the replacement of an inking roller of a rotary printing press. As illustrated in FIGS. 1 and 2, the inking roller 7 is mounted between a pair of frame means 1 and 2 and conventionally functions to transfer the ink from an ink fountain roller K in FIG. 3, to a plate cylinder P. The inking roller 7 is provided with a pair of journals 11 and 12 which are coaxially and removably coupled to its opposite ends. The journals 11 and 12 are supported at the reduced diameter extensions thereof by bearing portions 9 and 10, respectively, on the frame means 1 and 2 not only for rotation but for linear reciprocation within limits. The inking roller 7 is therefore both rotatable and axially reciprocable with the journals.

The right hand journal 12, as seen in FIGS. 1 and 2, has a spur gear 13 nonrotatably mounted thereon whereby rotation is transmitted to the inking roller 7 from rotary drive means, not shown, of any known or suitable design. The left hand journal 11, on the other hand, is coupled to a linear drive linkage 17 which forms part of linear drive means for axially reciprocating the inking roller 7.

Removably mounted to the frame means 1 and 2 are roller guide means 26 including a pair of guide rails 21 which extend horizontally under the inking roller 7 in parallel spaced relationship to each other. Upon disengagement from the journals 11 and 12, the inking roller 7 is free to roll on the guide rails 21 from a mount/dismount position $S_1$, FIG. 3, where the roller is mounted to and dismounted from the frame means 1 and 2 via the journals 11 and 12, to a load/unload position $S_2$ where the roller is loaded into and unloaded from the printing press.

The noted linear drive linkage 17 includes means 18 whereby the linkage is rendered nonfunctional and, instead, caused to permit the journal 11 to move axially away from the inking roller 7, on being unfastened therefrom, a sufficient distance to come out of engagement therewith, and to permit the roller to travel on the guide rails 21 from mount/dismount position $S_1$ to load/unload position $S_2$. The broken lines in FIG. 1 indicate the linear drive linkage 17 as rendered nonfunctional, and the solid lines delineate the normal operable state of the drive linkage.

The following is a more detailed discussion, under separate headings, of the inking roller 7, the pair of journals 11 and 12, the linear drive linkage 17, and the roller guide means 26. How the inking roller is replaced will be explained following the discussion of the listed components.

INKING ROLLER

With reference to FIGS. 1 and 2 the inking roller 7 has a tubular body 3 with a length greater than the width of the image to be printed, and a pair of end caps 6 pressfitted in the opposite ends of the tubular body 3. The end caps 6 have depressions of short cylindrical shape formed coaxially therein for mating engagement with the journals 11 and 12, as will be detailed subsequently in the course of the detailed discussion of the journals 11 and 12. Further the end caps 6 are formed to include a pair of coaxial annular grooves 4 for rolling engagement with the guide rails 21 hereinafter sometimes referred to as a wheel means.

JOURNALS

As shown also FIGS. 1 and 2, the pair of journals 11 and 12 are supported as aforesaid by the pair of bearing portions 9 and 10 on the frame means 1 and 2. Formed on the inner ends of the journals 11 and 12 are collars 8 which are shaped and sized to fit closely in the depressions 5 in the end caps 6 of the inking roller 7. The bottoms of the depressions 5 should be at right angles to the aligned axis of the inking roller 7 and the journals 11 and 12, and so should be the surfaces of the collars 8 contacting the bottoms of the depressions 5.

In FIG. 2 is shown the left hand journal 11 coupled to the inking roller 7, and the right hand journal 12 uncoupled therefrom. It will be noted from this figure, as well as from FIG. 3 which shows the end view of the inking roller, that each journal is coupled to the inking roller by a plurality, four in the illustrated embodiment, fastener elements such as screws 28 extending through clearance holes in the collar 8 and engaged in tapped holes 27 in the roller end cap 6.

Thus the journals 11 and 12 can be coupled to the inking roller 7 with a high degree of alignment and against the possibility of accidental misalignment during operation. All that is necessary to attain these goals is to push the journal collars 8 into at least partial engagement in the roller end cap depressions 5 and to turn the screws 28 into the tapped holes 27 until the collars become held fast against the bottoms of the depressions.

For disconnecting the journals 11 and 12 from the inking roller 7, on the other hand, all the screws 28 may be loosened. Then screws 28', which may be the screws that have just been loosed, may be turned into tapped holes 29 in the journal collars 8 into abutment against the bottoms of the inking roller end caps 6. The journal collars 8 will become dislodged from the inking roller end cap depressions 5, as in FIG. 2, as the screws 28' are further driven into the tapped holes 29.

Preferably, annular indentations or the like may be formed at those parts of the bottoms of the inking roller end cap depressions 5 against which the screws 28' are to come into abutment. Such indentations or the like are intended to assure proper positioning of the journal collars 8 in the depressions 5 even if the bottoms of the depressions are somewhat deformed by the butting of the screws 28'.

LINEAR DRIVE LINKAGE

The linear drive linkage 17 functions as aforesaid to cause axial reciprocation of the inking roller 7. As illustrated in FIG. 1, the linear drive linkage 17 includes a lever 30 having a first end pinned at 31 to linearly reciprocating drive means 16, and a second end pinned at 32 to the cup 15 of a bearing 14 mounted to the reduced diameter extension of the journal 11. The lever 30 has its opposite ends slotted for slidably receiving the pins 31 and 32 and is medially fulcrumed by a pivot pin 34 on a bracket 33 fastened to the frame wall 1. Thus the drive linkage 17 transmits the linear reciprocation of the drive means 16 to the journal 11 and thence to the inking roller 7, without interfering with the rotation of the inking roller in so doing.

The journal 11 to which the linear drive linkage 17 is engaged, as well as the other journal 12 on which the rotary drive gear 13 is mounted, must be axially retractable away from the inking roller 7 a sufficient distance to come out of driving engagement therewith and to permit the roller to travel laterally away from, and a new inking roller to come rolling to, the mount/dismount position $S_1$. Toward this end the bracket 33 is formed to include a segment 35 which is normally screwed or otherwise removably affixed to the rest of the bracket 33 to retain the pivot pin 34 of the lever 30 in position. The lever 30 will be deprived of its fulcrum when the bracket segment 35 is unfastened, with the result that the inking roller 7 is freed from the restraints of the linear drive linkage 17.

ROLLER GUIDE MEANS

Figure 3:
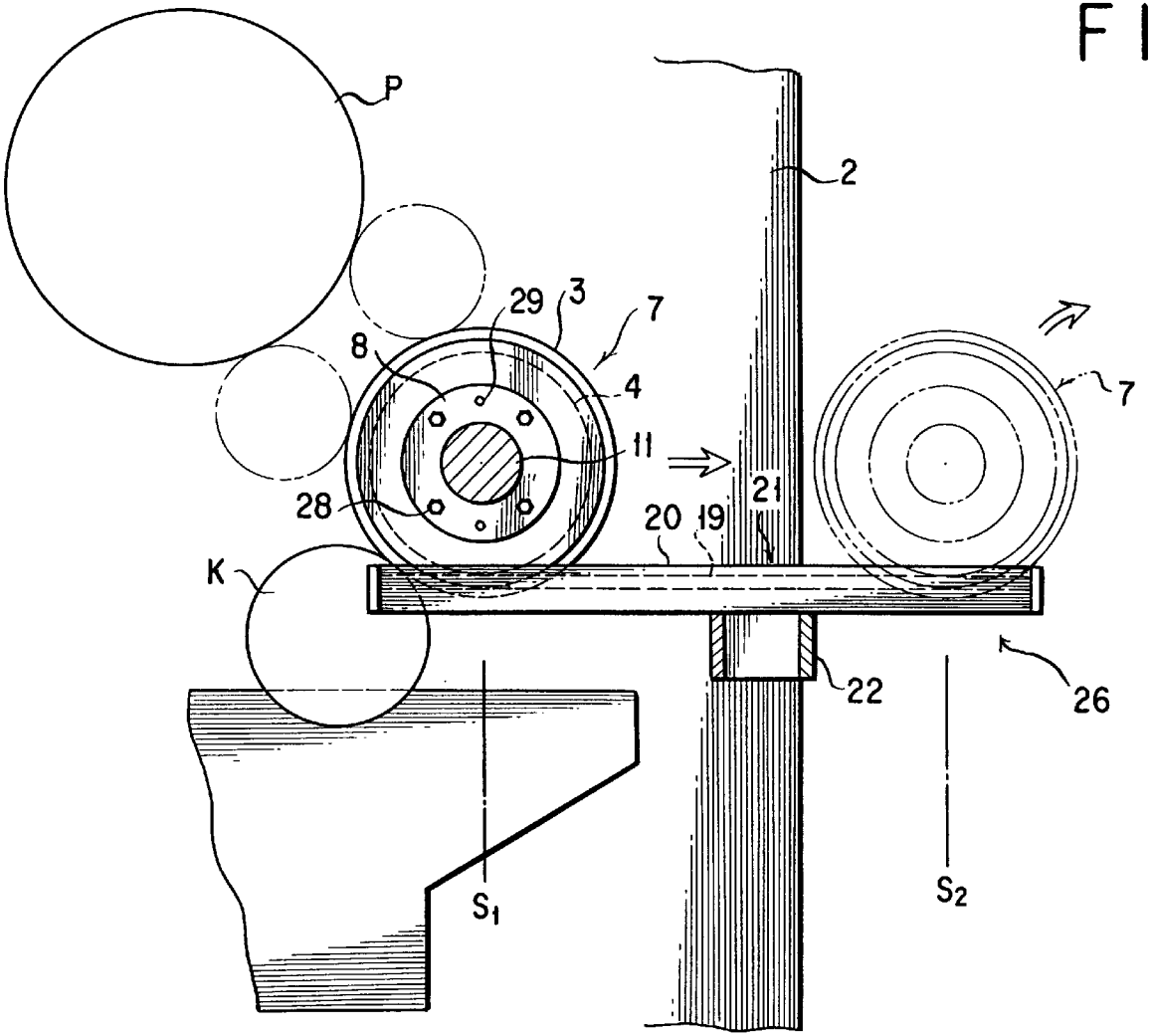
FIG. 3 is a section taken along the line III—III in FIG. 2 and showing in particular how the inking roller, disconnected from the pair of journals, is withdrawn from the press.

As seen in all of FIGS. 1–3, the roller guide means 26 include the pair of guide rails 21 removably bracketed at 22 and 23 to the frame means 1 and 2 so as to extend horizontally under the inking roller 7 in parallel spaced relationship to each other. The guide rails 21 are each approximately in the shape of the letter U, including a rail flange 19 shown engaged in one of the pair of annular grooves 4 in the inking roller end caps 6, and a stop flange 20 for preventing any accidental derailment of the inking roller 7. The guide rails 21 extend between mount/dismount position $S_1$ and load/unload position $S_2$. It is to be noted that the guide rails 21 with the brackets 22 and 23 are dismounted from the frame means 1 and 2 during the normal printing operation of the press and are to be mounted in position only when the inking roller 7 is to be replaced.

Figure 4:
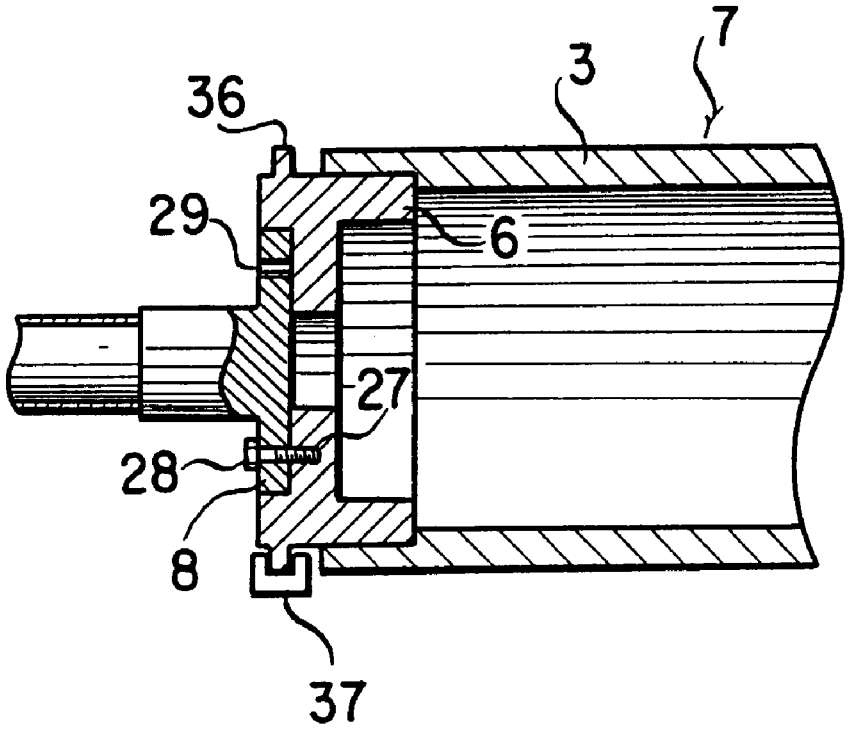
FIG. 4 is a fragmentary axial section of a slight modification of the inking roller of FIGS. 1–3 shown together with a correspondingly modified guide rail.

Alternatively, instead of engaging the rail flanges 19 of the guide rails 21 in the grooves 4 in the inking roller end caps 6, wheels may be formed as at 36 in FIG. 4 on the inking roller end caps for rolling engagement in grooves defined by guide rails 37 of U shaped cross section. As a further alternative, the stop flanges 20 of the rails 21 could be omitted.

INKING ROLLER REPLACEMENT

The printing press may be set out of operation when the inking roller 7 is worn or damaged to such an extent as to need replacement. Then the pair of guide rails 21 may be mounted via the brackets 22 and 23 to the pair of frame means 1 and 2, in such a manner that the upstanding flanges 19 of the rails become engaged in the annular grooves 4 in the inking roller end caps 6.

Possibly,such being the stroke of the axial reciprocation of the inking roller 7, this roller may have been stopped with its annular grooves 4 out of alignment with the rail flanges 19. In that event the machine may be set into inching operation, causing axial displacement of the inking roller 7 bit by bit until its grooves 4 come into alignment with the rail flanges 19. The guide rails 21 may be remounted after readjusting the axial position of the inking roller 7 as above.

The next step is the unfastening of the bracket segment 35 of the linear drive linkage 17. With the consequent release of the pivot pin 34 from the bracket 33, the journal side end of the lever 30 is free to pivot about the pivot pin 31 on the linear drive means 16 through a much greater angle than when the pivot pin 34 is affixed to the bracket 33.

Then the pair of journals 11 and 12 may both be unfastened from the inking roller 7 and moved axially away therefrom, leaving the roller resting on the pair of guide rails 21 in the mount/dismount position $S_1$. More specifically, for such journal disconnection, all the screws 28 fastening the journal collars 8 to the inking roller end caps 6 may be loosened. The journal collars 8 will remain engaged in, and bottomed against, the depressions 5 in the inking roller end caps 6 even after removal of all the screws 28. Then the screws 28', which may be those which have been just removed, may be driven into the tapped holes 29 in the journal collars 8 and into abutment against the bottoms of the inking roller end cap depressions 5. The journal collars 8 will gradually come out of the inking roller end cap depressions 5 with the continued driving of the screws 28' after they have come into abutment against the bottoms of the depressions.

Since the bracket segment 35 of the linear drive linkage 17 has been unfastened as above, the lever 30 will pivot about the pin 31 on the linear drive means 16, instead of on the median pivot 34, with such axial travel of the journal 11. The stroke of the lever 30 is now so long that the journal 11 will come out of the inking roller end cap depression 5 without interference from the linear drive linkage 17. The other journal 12 will be likewise disengaged from the inking roller 7 by traveling axially away therefrom a distance short enough to hold the spur gear 13 in mesh with the driving gear.

Disconnected from both journals 11 and 12 as above, the inking roller 7 will be resting on the pair of guide rails 21 with its annular grooves 4 receiving the rails flanges 19 of the rails. Then the inking roller may be rolled over the pair of guide rails 21 from mount/dismount position $S_1$ to load/unload position $S_2$, in which latter position the roller may be unloaded from the rails for withdrawal from the machine.

A new inking roller to be mounted to the press, which is understood to be identical in construction with the roller 7 which has been just unloaded, may be loaded on the pair of guide rails 21 in the load/unload position $S_2$, with the rail flanges 19 of the rails engaged in the annular grooves 4 of the roller. The roller may then be rolled on the guide rails to the mount/dismount position $S_1$ where the roller comes into axial alignment with the pair of journals 11 and 12.

Then the screws 28 may be inserted in and through the clearance holes in the journal collars 8 into the tapped holes 27 in the inking roller end caps 6. As the screws 28 are fully driven into the holes, the journal collars 8 will be fully received in the depressions 5 in the inking roller end caps 6. According to a feature of this invention, the full engagement of the journal collars 8 in the inking roller end cap depressions 5 is tantamount to the connection of the journals 11 and 12 to the inking roller 7 in precise axial alignment. There is actually no risk of the inking roller being coupled to the pair of journals in other than the correct positional relationship.

Then the bracket segment 35 of the linear drive linkage 17 may be screwed back to the bracket 33 in order to support the pivot pin 34 of the lever 30 on the bracket. The linear drive linkage 17 has now returned to its normal operating state, the lever 30 being fulcrumed on the bracket 33 to transmit the reciprocation of the drive means 16 to the inking roller 7.

Then the pair of guide rails 21 together with the brackets 22 and 23 may be removed from the frame means 1 and 2. The printing press is now ready for resumption of printing operation.

Although the present invention has been disclosed as embodied in a rotary printing press and as applied to the replacement of an inking roller, it is not desired that the invention be limited by this specific embodiment and application. A variety of other uses may suggest themselves to one skilled in the art. Further a variety of modifications or alterations in the details of the illustrated embodiment will occur to the specialists in order to conform to design preferences or to meet the requirements of each application. It is therefore appropriate that the invention should be construed broadly and in a manner consistent with the fair meaning or proper scope of the subjoined claims.

What is claimed is:

1. A rotary printing press, in combination:

(a) frame means;

(b) an inking roller having a pair of wheel means formed coaxially on opposite ends thereof;

(c) a pair of journals coaxially and detachably coupled to the opposite ends of the roller in driving engagement therewith, the journals being supported by the frame means for both rotation and axial reciprocation with the roller;

(d) a pair of guide rails removably mounted to the frame means and extending in parallel spaced relationship to each other in a direction at right angles with the axis of the roller for permitting the roller, on being uncoupled from the journals, to roll on the guide rails, with the wheel means in rolling engagement therewith, the guide rails extending from a mount/dismount position, where the roller is mounted to and dismounted from the frame means via the journals, and a load/unload position where the roller is loaded into and unloaded from the machine; and (e) reciprocating means, coupled to one of the journals for axially reciprocating the roller relative to the frame means, the reciprocating means including means to make said one journal free from restraint and to permit said one journal to travel axially away from the roller, on being uncoupled therefrom, a sufficient distance to come out of driving engagement with the roller and to enable the roller to travel laterally along the pair of guide rails.

2. The printing press of claim 1 wherein the roller has a pair of depressions formed coaxially in the opposite ends thereof, and wherein the pair of journals are detachably coupled to the roller via a pair of collars which are formed one on each journal and which are received in the depressions in the roller.

3. The printing press of claim 2 wherein the journals are detachably coupled to the roller by a plurality of fastener elements fastening the collars of the journals to the opposite ends of the roller, and wherein the collars have tapped holes formed therein for permitting screws to be turned into abutment against the opposite ends of the roller and further driven into the tapped holes to detach the journals from the roller after the fasten elements are loosed.

4. The printing press of claim 1 wherein the pair of wheel means are means defining a pair of annular grooves for receiving the guide rails.

5. The printing press of claim 1 wherein the pair of wheel means are wheels received in grooves defined by the guide rails.

6. The printing press of claim 1 wherein the reciprocating means comprises:

(a) linearly reciprocating drive means;

(b) a lever having a first end operatively coupled to the drive means and a second end operatively coupled to said one journal; and (c) fulcrum means to which the lever is medially pivoted, the fulcrum means permitting the medial pivot of the lever to be removed therefrom to make said one journal free from the restraint of the lever.

7. The printing press of claim 6 wherein the fulcrum means comprises a bracket formed on the frame means for supporting a pin on which the lever is medially pivoted, the bracket having a segment which is detachable to free the pin from the bracket.

8. A rotary printing press, in combination:

(a) frame means;

(b) an inking roller having a pair of wheel means formed coaxially on opposite ends thereof;

(c) a pair of journals coaxially and detachably coupled to the opposite ends of the roller in driving engagement therewith, the journals being supported by the frame means for both rotation and axial reciprocation with the roller;

(d) a pair of guide rails removably mounted to the frame means and extending in parallel spaced relationship to each other in a direction at right angles with the axis of the roller for permitting the roller, on being uncoupled from the journals, to roll on the guide rails, with the wheel means in rolling engagement therewith, the guide rails extending from a mount/dismount position, where the roller is mounted to and dismounted from the frame means via the journals, and a load/unload position where the roller is loaded into and unloaded from the machine; and (e) reciprocating means coupled to one of the journals for axially reciprocating the roller relative to the frame means, the reciprocating means being adapted to make said one journal free from the restraint of the reciprocating means to permit said one journal to travel axially away from the roller, on being uncoupled therefrom, a sufficient distance to come out of driving engagement with the roller and to enable to travel the roller laterally along the pair of guide rails; wherein the reciprocating means comprises:

(i) linearly reciprocating drive means;

(ii) a lever having a first end operatively coupled to the drive means and a second end operatively coupled to said one journal; and (iii) fulcrum means to which the lever is medially pivoted, the fulcrum means permitting the medial pivot of the lever to be removed therefrom to make said one journal free from the restraint of the lever; wherein the fulcrum means comprises a bracket formed on the frame means for supporting a pin on which the lever is medially pivoted, the bracket having a segment which is detachable to free the pin from the bracket.

* * * * *